US005645483A

United States Patent [19]

Cushman

[11] Patent Number: 5,645,483

[45] Date of Patent: Jul. 8, 1997

[54] SMOKE REDUCING POWER ROOF VENTILATOR

[75] Inventor: Stewart Cushman, 138 Kirkland Dr., Naples, Fla. 34110

[73] Assignee: Stewart Cushman, Naples, Fla.

[21] Appl. No.: 695,898

[22] Filed: Aug. 12, 1996

[51] Int. Cl.[6] ..... F24F 7/007

[52] U.S. Cl. ..... 454/353; 454/352; 454/341

[58] Field of Search ..... 126/244 R, 244 D; 454/341, 345, 347, 352, 353, 356

[56] References Cited

U.S. PATENT DOCUMENTS

| | | | |
|---|---|---|---|
| 2,812,703 | 11/1957 | Tobey | 454/352 |
| 2,854,916 | 10/1958 | Knutson et al. | 454/352 |
| 2,875,678 | 3/1959 | Shepherd | 454/356 X |
| 2,900,892 | 8/1959 | Shepherd | 454/356 X |
| 3,472,150 | 10/1969 | Strawsine | 454/353 |

FOREIGN PATENT DOCUMENTS

| | | | |
|---|---|---|---|
| 1110061 | 2/1956 | France | 454/341 |

*Primary Examiner*—Harold Joyce

[57] ABSTRACT

A ventilator to be mounted over a square opening in a roof of an establishment producing smoke below. The ventilator has a lower transitional section transforming a square configuration into a round configuration and an upper section in the shape of a cylinder attached to the lower section. The cylinder has an axial force fan mounted therein to create an upwardly moving stream of smoke-laden air therein. The lower section has symmetrically spaced lateral openings in its wall to cause an aspiration of ambient air into the air stream to thereby mix ambient air into the air stream and to thereby reduce the concentration of smoke micro-particles being emitted into the ambient air surrounding the establishment. On top of the cylinder there is provided a self-operating cover to close the ventilator when not in use.

15 Claims, 6 Drawing Sheets

SMOKE REDUCING POWER ROOF VENTILATOR

BACKGROUND OF THE INVENTION

The present invention is a power roof ventilator which is installed on the roof of a restaurant to exhaust the grease- and smoke-laden air from the hoods of ranges and grills below. Such ventilators are installed where a vertical discharge of the air is required. Typical installations are found on the roof of all types of commercial and institutional kitchens, such as restaurant and cafeteria, fast food, hotel and motel, bakery, delicatessen, school, hospital and military.

In many instances the above named kitchens are located in the vicinity of residential neighborhoods or recreational areas or in a garden-type setting, where the dining takes place, and is enjoyed in an outdoor setting. While the heretofore known ventilators do an adequate job in exhausting the air from the hoods of the kitchens, they also create a nuisance by exhausting the foul smelling smoke into the vicinity of the restaurant and its surroundings which is very objectionable because the smoke can spread around and within quite an area. For example, in a typical motel setting, there is a grill operating on the premises and the guests enjoying the swimming pool are subjected to the foul smelling smoke being exhausted on the roof which detracts from the enjoyment of the pool and leads to complaints. One such ventilator is known and produced by ILG INDUSTRIES DIVISION and identified as the type UBC centrifugal upblast power roof ventilator. The UBC power ventilator is said to have a powerful vertical discharge exhaust of contaminated air high above roof levels preventing recirculation into adjacent air intakes. However, the smoke that is exhausted is exhausted as is and is not treated at all. Grease-laden smoke consists of micro particles which may cling to each other and form a certain density with the surrounding air and under certain weather conditions, such as high humidity, may form a blanket of foul smelling air over a considerably large area.

OBJECTS OF THE INVENTION

The object of the invention is to improve the condition of the air being exhausted from the hoods of the kitchens of the type of restaurants named above. The roof ventilator of the invention is extremely simple in its construction but its best feature is that it treats the smoke-laden air after it emanates from the hoods mentioned above but before it is discharged in an upward blast. This is accomplished by constructing the ventilator in such a manner that ambient air is added to the smoke-laden air as it is blasted through the ventilator. In this manner, the density of the smoke-laden air is greatly reduced and the micro particles of the smoke are widely dispersed within the ambient air and do not create the nuisance of the typical smell prevailing around restaurants operating grills on their premises.

SUMMARY OF THE INVENTION

With the above objects in mind, The ventilator of the invention is constructed in such a manner that ambient air is added to the smoke-laden stream just above the roof level but below the fan that creates the air stream and the ambient air is added laterally, that is, at right angles to the smoke-laden air. Just below the cylinder, that houses the fan and its drive, symmetrically placed openings have been placed in the wall of a lower section where the ambient air can enter. The invention takes advantage of the well known venturi effect wherein a stream of confined and fast moving air will take along other air if there is an opening in its confinement. The confinement is the cylinder containing the fan and the opening is the symmetrically placed openings just below the cylinder. Extensive experiments have shown that there must be a certain ratio between the sizes of the openings of the symmetrically placed lateral openings and the size of the opening in the roof coming from the hoods below. If the total size of the lateral openings is too small, then the smoke-laden air coming from below will not be saturated enough with the ambient air and the density of the micro particles will not be dissipated to the extent to be effective to reduce the obnoxious odor of the smoke.

On the other hand, if the total size of the lateral openings is too large, when compared to the opening in the roof, then the ventilator is ineffective to draw enough smoke from the hoods below because most of the air that is exhausted is drawn from the lateral openings. It has been found that the ratio between the openings should be about 40 to 60% with a percentage of about 50% being preferred. For example, a typical installation on a roof would have a roof opening of about 25" square, that is, 625 square inches. There are four lateral openings each of a size of 80 square inches for a total of 320 square inches which is about 50% of the roof opening. The same ratio should be maintained when constructing ventilators of different sizes. Of course, the preferred ratio varies with a change in the RPM of the fan, hence, the indication of a ratio of 40 to 60%. It is also noted here that the fan itself is not a centrifugal fan, as is used in the Type UBC ventilator identified above, but it is an axial force fan and thereby creates a straight column of air moving through the cylindrical housing at about 5500 CFM with a fan rotation of about 1725 RPM. This straight column of air is essential to create the venturi effect noted above.

DETAILED DESCRIPTION OF THE DRAWINGS

Figure 1:
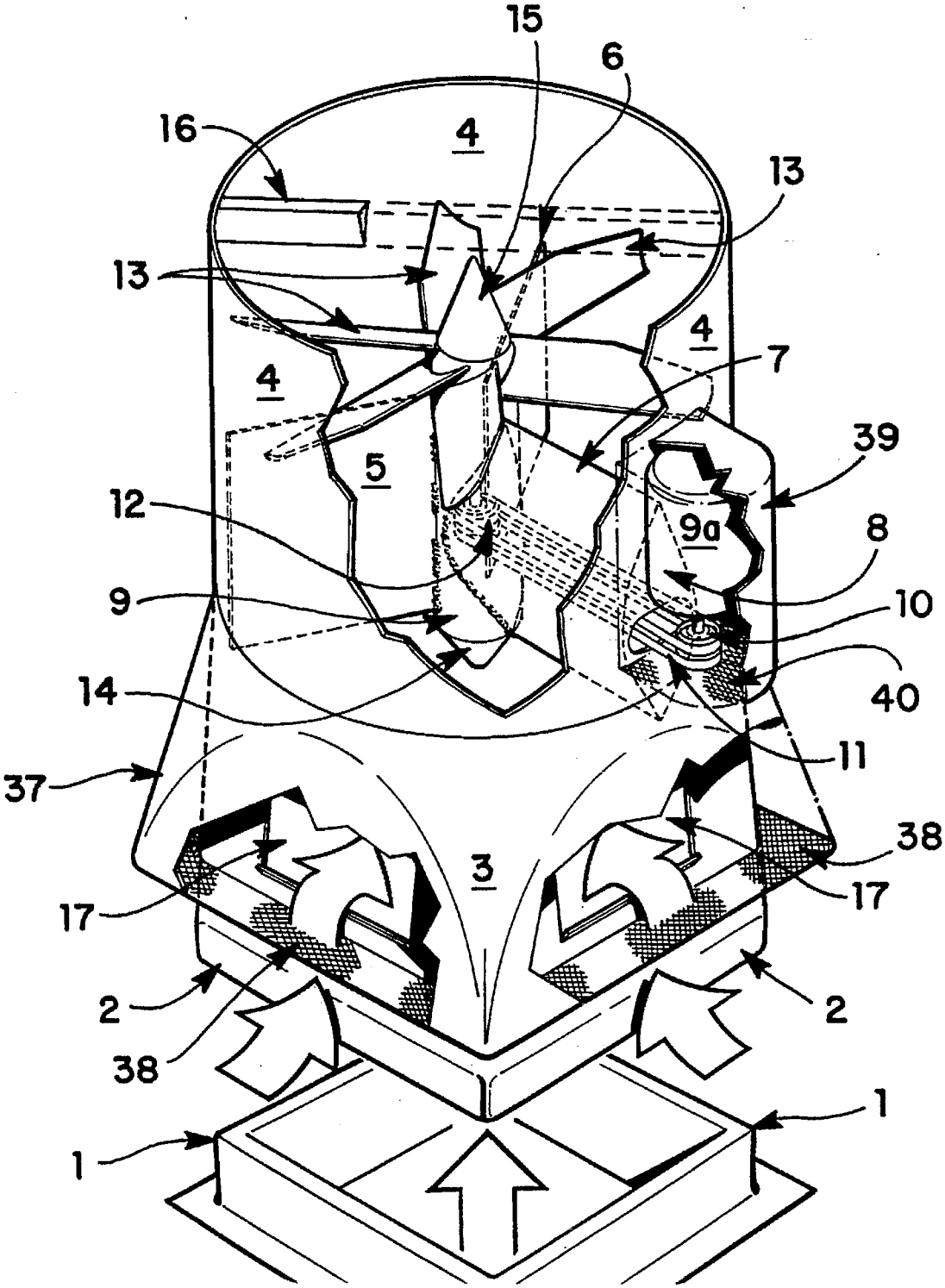
FIG. 1 is an isometric view of the ventilator with some parts broken away to allow a view of some of the interior.
Figure 2:
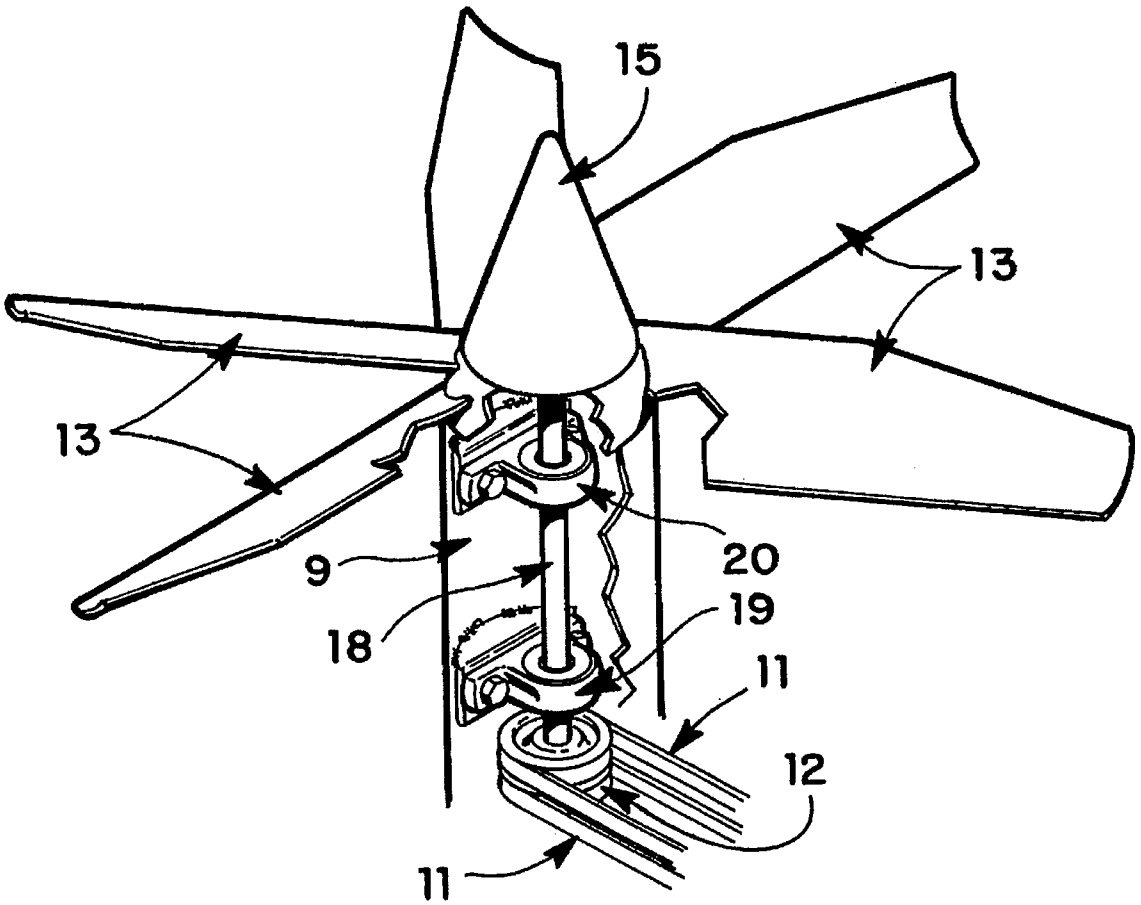
FIG. 2 is as an isometric view of the mounting of the fan and its drive.

FIG. 1 is an isometric view of the ventilator as it is to be mounted on a roof of a restaurant, for example, wherein 1 shows a typical square opening in the roof having upstanding curbs. The lower part of the ventilator has a matching square opening 2 which is fitted over the opening 1 of the roof to embrace the upstanding curbs. A lower part of the ventilator has a transitional section 3 which transforms the square configuration of the ventilator housing at its lower end to a round configuration at its end where it meets a round cylinder 4. Within cylinder 4 there are three vertically arranged mounting plates 5, 6, and 7 and fastened therein. They are equidistantly spaced from each other and meet a cylindrical support column 9 and are fastened thereto. It is noted that mounting plate 7 actually consists of two plates 7 and 8 which are fastened to each other at their horizontal edges but are spaced apart from each other at their middle. This way they are forming an elliptically shaped hollow support tunnel. The elliptic shape is designed such that it offers the least resistance to the air stream flowing through the cylinder. A matching elliptic opening is provided in the cylindrical support 9 located in the center of the cylinder 9 and another elliptic opening is provided in the outer wall of cylinder 4 and the elliptical support 7, 8 is welded to each of the openings. An electrical motor 9*a* is mounted on the outside of cylinder 4 and with pulley 10 drives either one or two drive belts 11 which in turn drive the pulley 12 of the fan shaft 18 (FIG. 2). The drive belts 11 that are driving the fan shaft 18 are operating through the hollow support 7, 8 and thereby are hermetically sealed from the smoke-laden air stream passing through the cylinder 4 and, thereby cannot be contaminated by any grease contained in the smoke.

The support for fan shaft 18 will be explained with reference to FIG. 2. The cylindrical support 9 for the fan drive shows a cone 14 at its lower end. A fan having fan blades 13 is mounted to the fan drive shaft 18 and a cone 15 is mounted at the center of the fan blades 13. The cones will aid in the proper dynamics of the air flow so as not to deflect the same and/or to avoid any eddy currents within the air stream. A brace 16 in the shape of a wedge is diagionally mounted across the opening of cylinder 4 and at its top. The wedge shape of brace 16 again is aero-dynamically designed because it is located in the air stream in the cylinder. The purpose of the brace will be explained later with reference to other FIGS. Attention now is directed to the lateral openings 17 which are symmetrically spaced in the wall and around the lower transition section 3 of the ventilator. The arrows indicate the flow of the ambient air being aspirated into the smoke-laden air stream coming from below when the ventilator is in an operating mode. A flaring skirt 37 surrounds the lower section 3 to keep rain water from being aspirated into the air stream and at the same time to provide a support for a screen 38 to keep animals such as birds or vermin out of the system.

The motor 9*a* which is mounted on the outside of the cylinder 4 is also protected from the environment by a shroud 39 surrounding the same and again a protective screen 40 is provided at the bottom thereof.

Turning now to FIG. 2, the cylindrical support 9 is illustrated as partially open and shows two bearings 19 an 20 which support the fan shaft 18. Also illustrated are the pulley 12 and the one or two drive belts 11 also notice the fan blades 13 and the cone mounted in the center thereof. Again it is noted that all drives including the bearing supports are hermetically sealed from the smoke-laden air passing through the ventilator.

Figure 3:
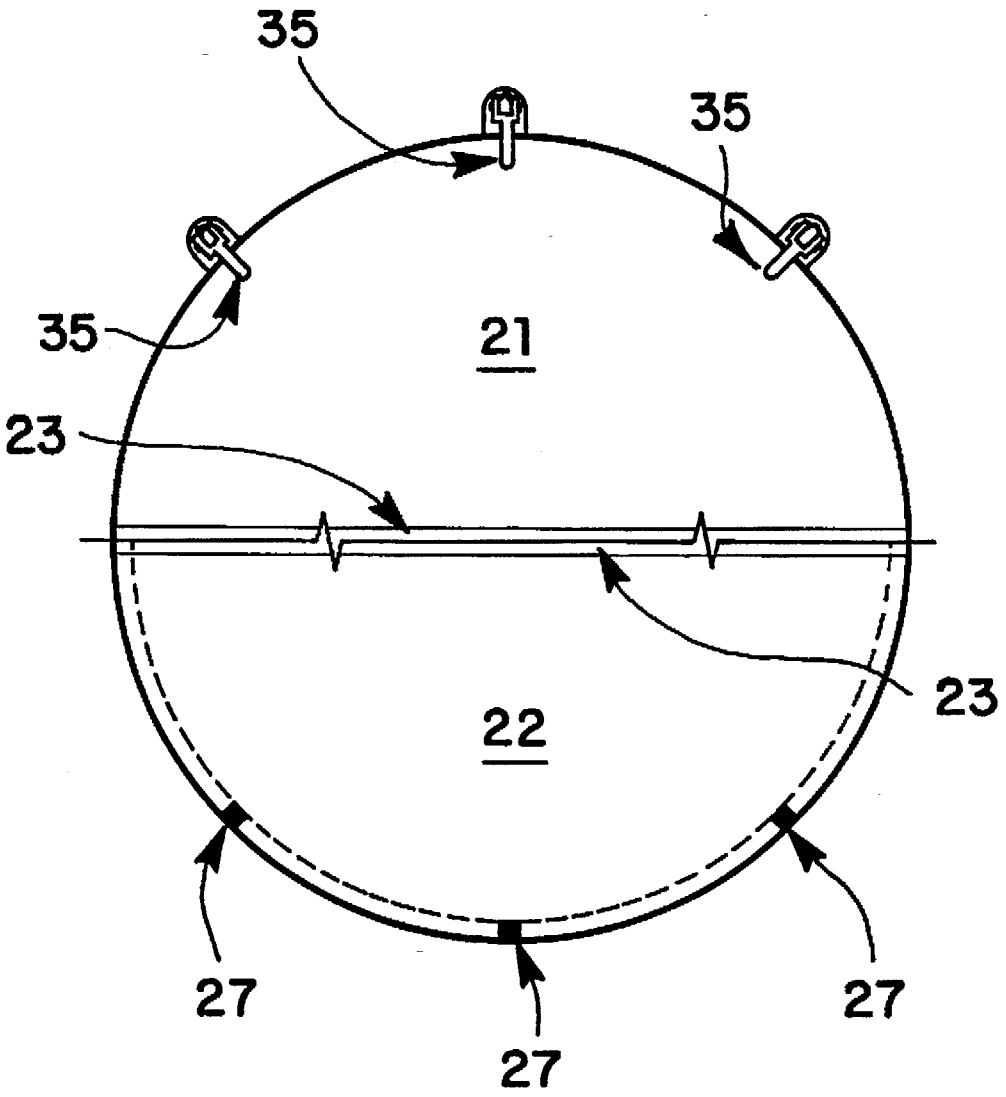
FIG. 3 is a top view of the ventilator.

FIG. 3 shows a top view of the ventilator and particularly two cover plates 21 and 22 in the shape of semi-circles or sectors of a circle. The plates are hinged by a hinge 23 (shown only schematically here). When the ventilator is not in operation it is imperative that the top of cylinder 4 be closed to keep rain out of the system including other disturbances such as down drafts etc. Therefore, when the operation of the ventilator ceases, the two hinged plates will automatically move down into a closed position and will resume an upstanding position virtually by the force of the air flow when operation resumes. When the two plates 21 and 22 are in their closed position there is a danger that the plates will move up and down or flutter because of possible air disturbances swirling around the top of the roof where the ventilator is mounted. To prevent the above noted occurrences from happening, special hold-downs have been added to obtain a positive lock-down of the plates. Thus, magnets 27 are shown schematically and so are mechanical clamps 35, which will be explained below. FIG. 3 shows three hold-downs for each plate but one or two may suffice.

Figure 4:
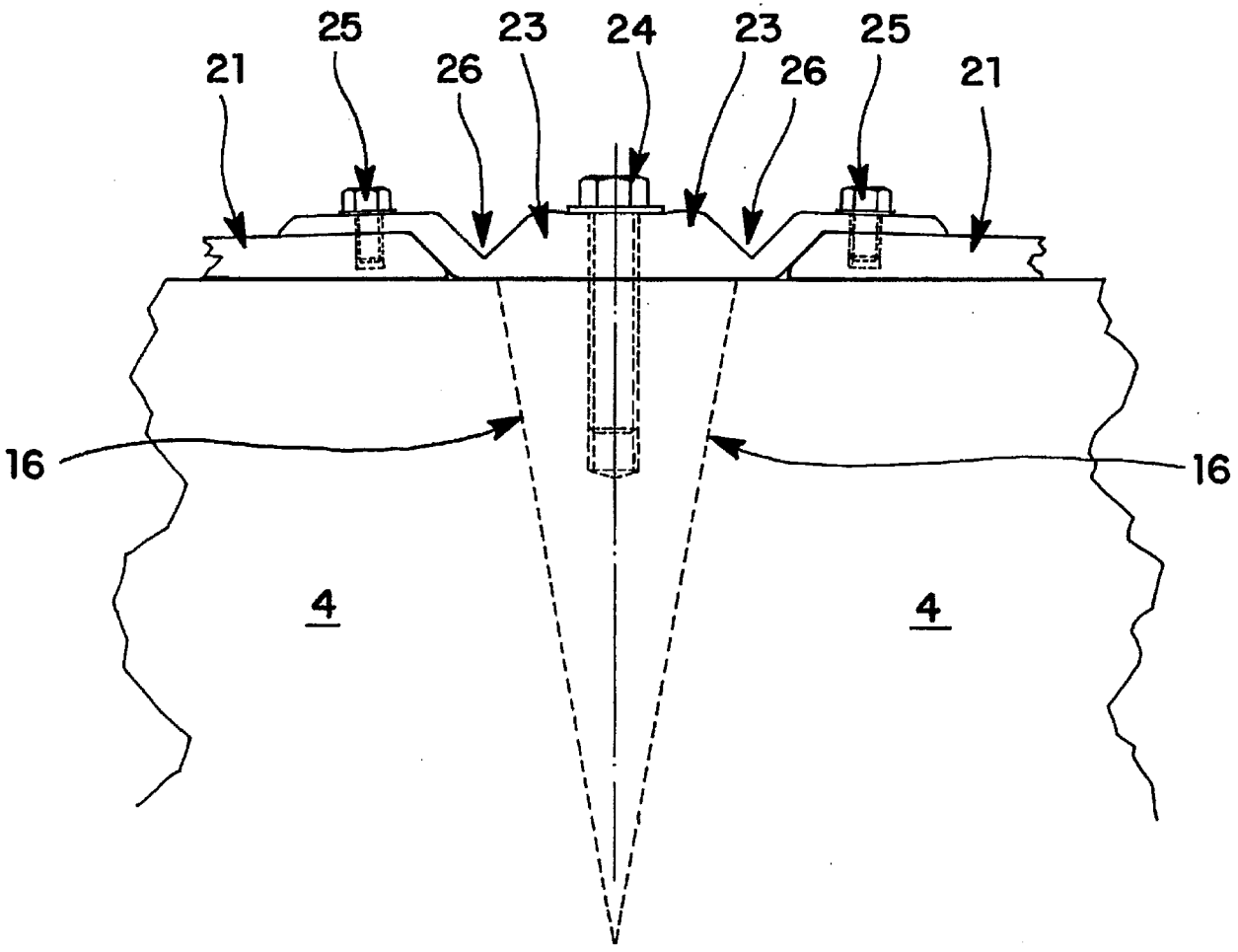
FIG. 4 is a side view of the ventilator at its top edge.

FIG. 4 is a side view of the cylinder 4 at the top. It illustrates a preferred form of the hinge 23 which is mounted to the above mentioned wedge shape brace 16 by way bolts 24. The hinge itself is made of extruded plastic material and is mounted to the cover plates 21 and 22 by way of bolts 25. The bolts 24 and 25 can be totally omitted because the hinge itself could be fastened to the brace 16 or the plates 21 and 22 by gluing or bonding. The notches 26 in the hinge material, which are elongated in the direction of extrusion, aid in the hinging action when the plates are either moving up or down and they offer the least resistance against movement or bending. Another advantage of a plastic hinge is that it is weather resistant and is completely water proof. If a hinge ever fails, it is easy to replace. Mechanical hinges have been contemplated but they do not offer the above noted advantages. Brass hinges either several in a row or a piano-type hinge may be weather resistant but they are extremely difficult to water proof when considering the location where they are used.

Figure 5:
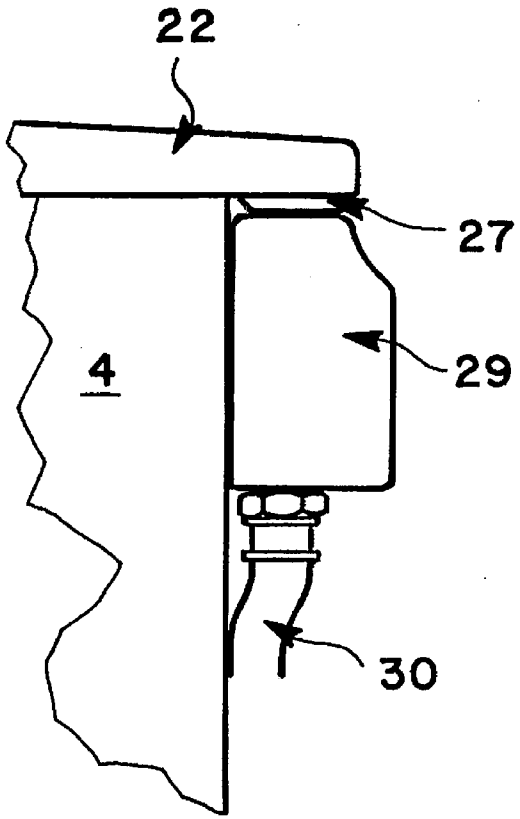
FIG. 5 shows an electro-mechanical hold-down for a top cover.

FIG. 5 illustrates an electromagnet hold-down device. Cover 22 shows a metal plate 27 attached to a protrusion. An electromagnet 29 is attached to the outside wall of the cylinder 4 and below the metal plate 27. An electric conduit 30 leads into the electromagnet 29 to energize the same when needed. The operation is as follows: When the ventilator is in an operating mode, the cover 22 (as well as 21) is in an upstanding position and the electromagnet 29 is de-energized. When the ventilator is turned off, gravity brings down the cover 22 and at the same time the electromagnet 29 is energized to thereby capture and hold the cover 22 by way of its metal plate 27. The reverse happens when the ventilator is turned on again.

Figure 6:
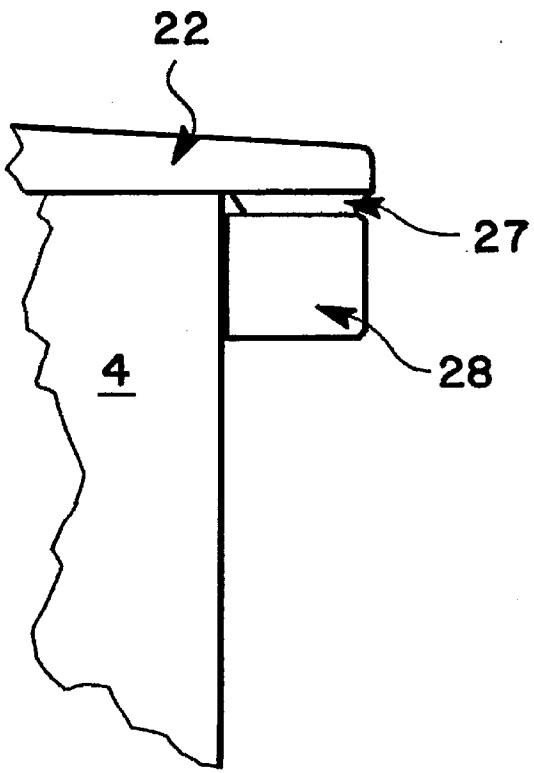
FIG. 6 shows a permanent magnetic hold-down for a top cover.

FIG. 6 illustrates a simplification of using permanent magnets as hold-down devices. The cover 22 still carries the metal plate 27 but mounted below the same is a permanent magnet 28. In the shown position the magnetic flux of permanent magnet 28 has attracted the metal plate 27 of cover 22 and holds the same in a closed position. When the ventilator is placed in operation, the high velocity air stream will overcome the magnetic force of magnet 28 and allow the cover to move to an upright and open position. Both magnets 28 and 29 can be enclosed in a plastic shroud in order to weather-proof the same without interfering in their proper function. Preferred magnets are cobalt magnets (Neodymium-Iron-Boron) because they literally can not be de-magnetized.

Figure 7B:
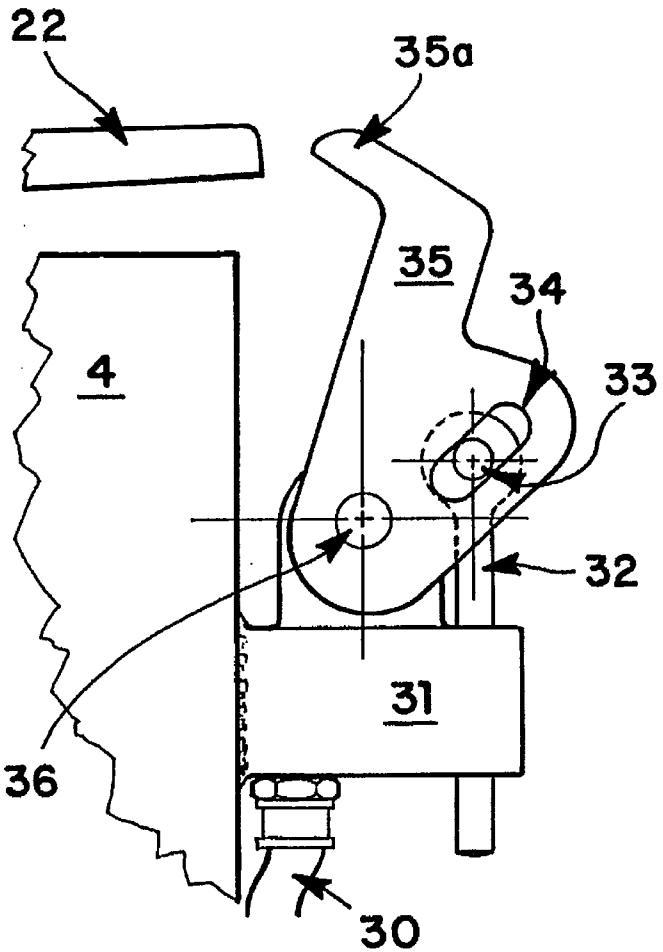
FIG. 7*b* shows the mechanical hold-down in its open position.
Figure 7A:
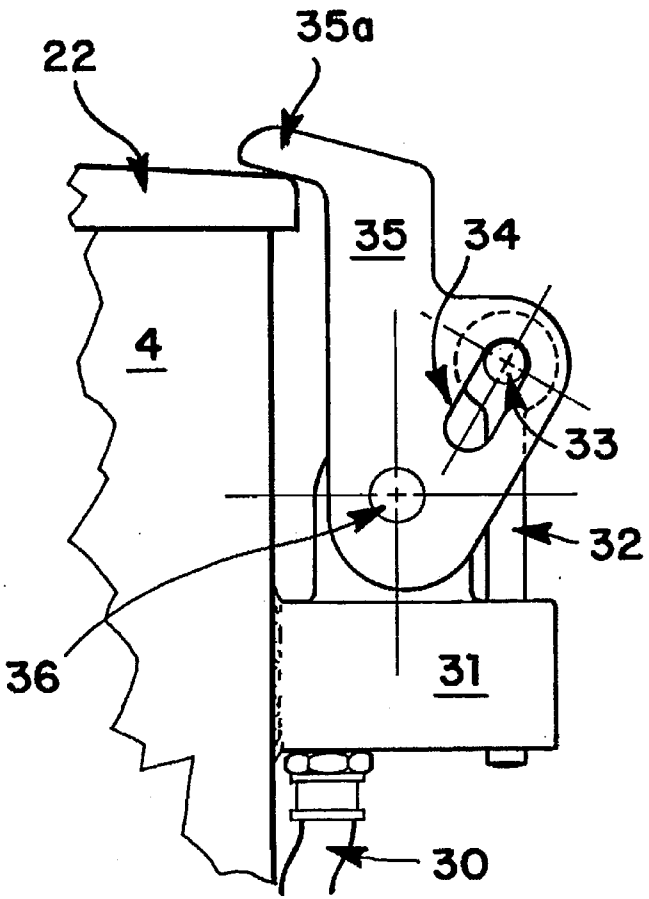
FIG. 7*a* shows a mechanical hold-down for a top cover in its locked position.

FIGS. 7*a* and 7*b* illustrate an electro-mechanical device involving clamping actions. To this end, a block 31 is attached to the outside wall of cylinder 4 which contains a solenoid (not shown). A metal rod extends from the solenoid in an upward direction and moves either up or down as dictated by the solenoid. The upper end of metal rod 32 carries a cross pin which moves in an elongated slot 34 of the clamping lever 35. the clamping lever 35 has an extension 35*a* which can move over an edge of cover 22 (FIG. 7*a*) or can move away therefrom (FIG. 7*b*).

The operation is as follows: FIG. 7*a* shows the cover 22 in a closed or locked position because the extension 35*a* has moved over the cover 22 and holds it down or locked. When the ventilator is started, the solenoid in block 31 is energized to thereby pull down the metal rod 32. The cross pin 33 is camming within the elongated slot 34 to thereby pull the clamping lever away from the cover 22 to release the same. The reverse happens when the ventilator is deactivated. The clamping lever is supported on the block 31 by way of the pin 36.

What I claim is:

1. A smoke reducing ventilator mounted over a square opening in a roof of an establishment where there is smoke produced below, said ventilator having a lower transitional section transforming a square configuration at its lower end to a round configuration at its upper end and said ventilator further having an upper section in the form of a cylinder conforming to said round configuration and attached thereto at a lower end, an axial force fan located in said cylinder and driven by a motor from the outside of said cylinder to create an upwardly moving smoke-laden air stream and a cover mounted on top of said cylinder, said cover being divided into two equal sectors and having hinge means at their dividing line diagonally across a top of said cylinder, said hinge means allowing said cover sectors to stand upwardly when the air stream is operating and move downwardly and into a closed position when there is an absence of the air stream, lateral openings symmetrically placed in said lower transitional section in its wall, whereby, when the smoke-laden air stream is moving through said lower section ambient air is aspirated through said lateral openings to substantially mix the ambient air into the smoke-laden air.

2. The ventilator of claim 1, wherein the total area of all of the lateral openings is 40 to 60% of the size of the square opening in the roof of the establishment.

3. The ventilator of claim 1, wherein the total area of all of the lateral openings is 50% of the size of the square opening in the roof of the establishment.

4. The ventilator of claim 1 including a cylindrical support means for supporting said fan including at least three support plates having horizontal edges and being symmetrically placed between the inner wall of said cylinder and an outer wall of said cylindrical support.

5. The ventilator of claim 4, wherein one of said support plates consists of two plates connected to each other at their horizontal edges but being spaced from each other at their middle to thereby form an elliptical shape and thereby being hollow at the interior.

6. The ventilator of claim 5, wherein the wall of said cylinder has an opening therein and wherein the wall of said cylindrical support has an opening therein and said elliptically shaped support plate is connected between said walls and over said openings to provide a drive tunnel from said motor to hermetically seal the same from the smoke-laden air passing through said ventilator.

7. The ventilator of claim 6, wherein at least one drive belt is driving said drive shaft from said motor through said tunnel.

8. The ventilator of claim 4, wherein bearings to support said fan drive are located within said cylindrical support.

9. The ventilator of claim 1, having a wedge-shaped brace located diagonally across a top of the cylinder and wherein said hinge means is a plastic hinge having means for fastening the same at its center to said wedge shaped brace and at its margins to each of said cover sectors and elongated notches are provided in said plastic to aid in the bending of the material and in their hinging action.

10. The ventilator of claim 1, including hold-down means for preventing said cover from moving upwardly accidentally.

11. The ventilator of claim 10, wherein said hold-down means is a an electromagnet.

12. The ventilator of claim 10, wherein said hold-down means is a permanent magnet.

13. The ventilator of claim 10, wherein said hold-down means is an electromechanical device.

14. The ventilator of claim 1, including a skirt attached to said lower section over said lateral openings and flaring away from the same and further forming a support means for attaching a screen to prevent animals from entering the system.

15. The ventilator of claim 1, including a shroud surrounding said motor to protect the same from the environment including a screen to prevent animals from entering the shroud.

* * * * *